US006189817B1

(12) United States Patent
Lambert

(10) Patent No.: US 6,189,817 B1
(45) Date of Patent: Feb. 20, 2001

(54) FUEL INJECTOR

(75) Inventor: Malcolm David Dick Lambert, Bromley (GB)

(73) Assignee: Delphi Technologies, Inc., Troy, MI (US)

( * ) Notice: Under 35 U.S.C. 154(b), the term of this patent shall be extended for 0 days.

(21) Appl. No.: 09/519,052

(22) Filed: Mar. 3, 2000

(30) Foreign Application Priority Data

Mar. 4, 1999 (GB) ..... 9904938

(51) Int. Cl.[7] ..... F02M 63/00

(52) U.S. Cl. ..... 239/533.2; 239/533.3; 239/533.4; 239/533.9; 239/533.11; 239/533.12

(58) Field of Search ..... 239/533.2, 533.3, 239/533.4, 533.5, 533.9, 533.11, 533.12, 585.1

(56) References Cited

U.S. PATENT DOCUMENTS 4,202,500 * 5/1980 Keiczek ..... 239/533.3
4,382,554 * 5/1983 Hofmann ..... 239/533.9
4,407,457 * 10/1983 Seifert ..... 239/533.12
4,658,824 * 4/1987 Scheibe ..... 239/533.3 X
5,458,292 * 10/1995 Hapeman ..... 239/533.4
5,899,389 * 4/1999 Pataki et al. ..... 239/533.2

* cited by examiner

*Primary Examiner*—Andres Kashnikow
*Assistant Examiner*—Robin O. Evans
(74) *Attorney, Agent, or Firm*—John A. VanOphem

(57) ABSTRACT

A fuel injector comprising a nozzle body provided with a first bore and defining a first seating, a valve member engageable with the first seating to control fuel flow from the first bore towards an outlet opening located downstream of the first seating, the valve member being provided with a second bore defining a second seating. A valve needle is slidable within the second bore and is engageable with the second seating to control fuel flow from the second bore towards a second outlet opening provided in the valve member. The fuel injector also includes a transmission arrangement whereby movement of the valve needle beyond a predetermined position is transmitted to the valve member.

17 Claims, 3 Drawing Sheets

10
11
11a
23
24a
26a 21
22
16b
16c
10
11
15
24
23
13
19
20
17
18
25
26
16
24
16a
12
14

FUEL INJECTOR

TECHNICAL FIELD

This invention relates to a fuel injector for use in supplying fuel under pressure to a combustion space of an engine. In particular, the invention relates to a fuel injector in which a characteristic of the fuel injector, for example the injection rate or spray form, can be altered, in use.

BACKGROUND OF THE INVENTION

It has been found that, with compression ignition internal combustion engines, the levels of noise and particulate emissions produced by the engine can be reduced by varying the rate at which fuel is supplied during each fuel injection cycle. For example, an injection cycle may include an initial phase during which fuel is supplied at a relatively low rate and a subsequent phase during which fuel is delivered at a higher rate. Alternatively, or additionally, other fuel injection characteristics may be varied. It is an object of the invention to provide a fuel injector meeting these requirements.

According to the present invention there is provided a fuel injector comprising a nozzle body provided with a first bore and defining a first seating, a valve member engageable with the first seating to control fuel flow from the first bore towards a first outlet opening located downstream of the first seating, the valve member being provided with a second bore defining a second seating, a valve needle being slidable within the second bore and being engageable with the second seating to control fuel flow from the second bore towards a second outlet opening provided in the valve member, and a transmission arrangement whereby movement of the valve needle beyond a predetermined position is transmitted to the valve member.

The nozzle body may be provided with a plurality of first outlet openings and the valve member may be provided with a plurality of second outlet openings.

The first and second outlet openings may be located such that, when the valve member engages the first seating and the valve needle is lifted from the second seating, the first and second outlet openings are arranged in series with one another, movement of the valve member away from the first seating permitting fuel delivery through the first outlet opening, by-passing the second outlet opening. It will be appreciated, that depending upon the shape and size of the first and second outlet openings, the fuel delivery rate or other fuel injection characteristics may be varied by varying the distance by which the valve needle is moved.

The number of first outlet openings may be equal to the number of second outlet openings. Alternatively, fewer second outlet openings may be provided, in which case only some of the first outlet openings are used to deliver fuel whilst the valve member engages the first seating and the valve needle is lifted away from the second seating.

Alternatively the valve member may include a tip portion provided with an opening to allow passage of fuel from the second bore to the first outlet opening, the tip portion being arranged to partially cover the first outlet opening when the valve member engages the first seating and being moveable to a position in which the first outlet opening is not covered by the tip portion.

The second outlet opening in the valve member may be an axially extending opening. Movement of the valve needle away from the second seating by an amount which does not exceed a predetermined amount permits fuel to flow from the second bore in the valve member through an axially extending opening into the first outlet opening. As the first outlet opening is partially obscured by the tip portion, the rate at which fuel is delivered is limited. As movement of the valve needle is not transmitted to the valve member, fuel does not flow past the first seating directly to the first outlet opening. Thus, fuel delivery occurs at a relatively low fuel delivery rate. Further movement of the valve needle away from the second seating beyond the predetermined amount results in movement of the valve member away from the first seating and thus permits fuel to flow from the first bore, past the first seating, directly to the first outlet opening, therefore by-passing the axially extending opening in the valve member. The movement of the valve member results in the tip portion moving to a position in which it does not throttle fuel delivery, thereby permitting a higher fuel delivery rate.

The tip portion may be of truncated, conical form, the tip portion partially covering the first outlet opening in the nozzle body when the valve member engages the first seating such that fuel flow through the opening is throttled, thereby permitting a low fuel delivery rate.

This embodiment of the invention provides the advantage that accurate radial guidance of the valve needle is not essential. The construction of the fuel injector is therefore less complex and manufacture is simplified. Additionally, the first outlet opening can be located at a lower axial position in the nozzle body, as there are no openings in the valve needle with which the first outlet opening must align. Thus, the allowable pressure limit for the injector can be increased.

The fuel injector conveniently includes a sac formed downstream of the first seating and communicating with the first outlet opening formed in the nozzle body, the axially extending opening in the valve member communicating with the sac to enable fuel to flow through the axially extending opening into the sac and out through the first outlet opening in the nozzle body. Preferably, the sac is of truncated conical form so as to minimise the dead volume.

BRIEF DESCRIPTION OF THE DRAWINGS

The invention will further be described, by way of example, with reference to the accompanying drawings, in which.

DESCRIPTION OF THE PREFERRED EMBODIMENTS

Figures 1, 2, 3, 4, 5:
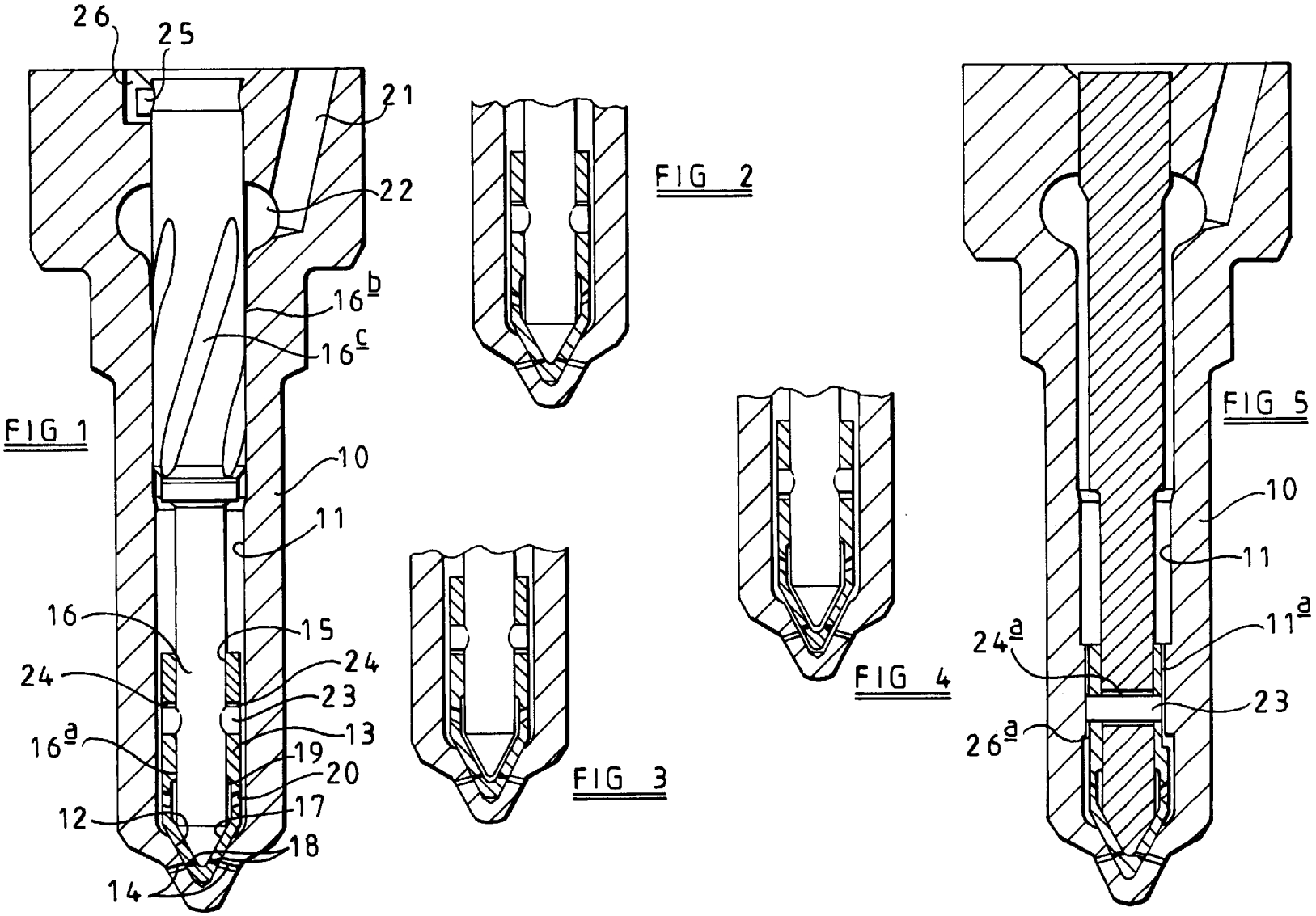
FIG. 1 is a sectional view of part of a fuel injector in accordance with an embodiment.
FIGS. 2, 3 and 4 are views illustrating operation of the injector of FIG. 1.
FIG. 5 is a view similar to FIG. 1 illustrating a second embodiment.

The fuel injector illustrated, in part, in FIG. 1 comprises a nozzle body 10 provided with a blind bore 11. The bore 11 defines, adjacent its blind end, a seating surface 12 with which a frusto-conical end region of a valve member 13 is engageable to control communication between the bore 11 and a plurality of first outlet openings 14 located downstream of the seating.

The valve member 13 is provided with a blind bore 15 within which a tip region 16*a* of a valve needle 16 is received. The tip region 16*a* is engageable with a second seating 17, a plurality of second outlet openings 18 opening into the bore 15 downstream of the line or area over which the valve needle 16 is engageable with the second seating 17.

The blind bore 15 is shaped to include a region of enlarged diameter which defines, with the needle 16, a chamber 19 upstream of the second seating 17 which communicates through drillings 20 with the interior of the bore 11. The bore 11 is arranged to receive fuel under high pressure from an appropriate fuel source, for example the common rail of a common rail fuel system which, in use, is charged to a suitably high pressure by an appropriate high pressure fuel pump. As illustrated in FIG. 1, the bore 11 receives the fuel under high pressure through a supply passage 21 which communicates with an annular gallery 22 defined by a part of the bore 11 of enlarged diameter.

The needle 16 is shaped to include, at its end remote from the tip region 16*a* thereof, a region of 16*b* diameter substantially equal to the diameter of the adjacent part of the bore 11. Engagement between this part of the needle 16 and the wall defining the bore 11 serves to guide the needle 16 for sliding movement within the bore 11. In order to permit fuel to flow from the annular gallery 22 towards the seatings and openings of the nozzle body 10 and valve member 13, the needle 16 is provided with a plurality of grooves or flutes 16*c* in a known manner.

The valve needle 16 is provided with an opening through which a load transmitting pin 23 extends, the pin 23 conveniently being an interference fit in the opening to secure the pin 23 to the needle 16. The ends of the pin 23 project radially from the valve needle 16 and extend into openings 24 provided in the valve member 13. The openings 24 are of width substantially equal to the diameter of the pin 23 but, in the orientation illustrated, are of height greater than the diameter of the pin 23. The positioning of the pin 23 and the openings 24 are such that, when the valve needle 16 engages the second seating 17 and the valve member 13 engages the first seating 12, the pin 23 is spaced slightly from the lower end of each opening 24, and is spaced by a greater distance from the upper end of each opening 24.

The upper end region of the needle 16 is provided with a radially extending projection or pin 25 which is received within a groove or slot 26 formed in the wall defining the bore 11, the interaction between the pin 25 and the groove or slot 26 is such as to prevent or significantly restrict angular movement of the needle 16 relative to the bore 11, but to permit axial movement of the needle 16. It will be appreciated that as angular movement between the needle 16 and the nozzle body 10 is inhibited, and the engagement of the pin 23 within the openings 24 substantially prevents angular movement occurring between the needle 16 and the valve member 13, that angular movement of the valve member 13 is not permitted. As angular movement of the valve member 13 is not permitted, the positioning of the first and second groups of openings 14, 18 can be chosen to ensure that when the valve member 13 engages the first seating surface 12, each of the second openings 18 communicates with a respective one of the first openings 14.

Although not illustrated in FIG. 1, the injector includes an appropriate actuator arrangement which is used to control movement of the valve needle 16. The actuator arrangement may take any suitable form and may, for example, comprise a piezoelectric stack arrangement, the axial length of the piezoelectric stack varying depending upon the magnitude of an electric field applied thereto. Although the needle 16 may be coupled directly to the piezoelectric stack, in order to compensate for changes in the axial length of the piezoelectric stack resulting, for example, from thermal expansion, a piston member may be located between the needle 16 and the piezoelectric stack, the piston member and needle 16 together defining a chamber which communicates through a restriction with a suitable fluid source, for example the supply passage 21.

FIGS. 1 and 2 illustrate the injector in an operating condition in which fuel is not to be delivered. In this condition, the actuator applies a downward force to the needle 16 sufficient to ensure that the needle 16 engages the second seating 17, the downward force being transmitted through the needle to the valve member 13 and ensuring that the valve member 13 engages the first seating 12. Due to the engagement between the valve needle 16 and the second seating 17 and between the valve member 13 and the first seating 12, it will be appreciated that fuel delivery is not permitted.

When injection of fuel is to commence, the magnitude of the downward force applied to the needle 16 is reduced. As a result, a point will be reached beyond which the fuel pressure within the bore 11 will apply a sufficiently large magnitude force to the needle 16 to cause the needle 16 to lift away from the second seating 17. Provided the distance moved by the needle 16 is sufficiently small that the pin 23 remains spaced from the upper ends of the openings 24, the movement of the needle 16 is not transmitted to the valve member 13, and the fuel pressure within the bore 11 acting upon the valve member 13 will ensure that the valve member 13 remains in engagement with the first seating 12. Such a position is illustrated in FIG. 3. In such circumstances, fuel is able to flow from the bore 11 through the drillings 20 to the chamber 19, and between the needle 16 and the second seating 17 to the second openings 18. The fuel flows through the second openings 18 to the first openings 14 and is delivered to a combustion space of the engine with which the injector is associated. It will be appreciated that the rate at which fuel is injected and the other injection characteristics depend upon the sizes of the first and second openings 14, 18 as well as the number of openings provided and the shapes of the openings. As the valve member 13 engages the first seating 12, it will be appreciated that fuel is unable to flow directly to the first openings 14.

Although, as described hereinbefore, the valve member 13 will remain in engagement with the first seating 12 due to the action of the fuel under pressure within the bore 11, if desired, a suitable spring may be provided between the valve member 13 and the needle 16 to apply a suitable downward biasing force to the valve member 13.

If desired, the delivery of fuel may be terminated by re-applying the original downward force to the needle 16 to return the needle 16 to the position illustrated in FIGS. 1 and 2.

Alternatively, if fuel injection is to continue but it is desired to achieve fuel injection at a different rate, the magnitude of the downward force applied to the needle 16 may be further reduced, the fuel pressure within the bore 11 causing additional movement of the needle 16 in an upward direction. The continued movement of the needle 16 results in the pin 23 moving into engagement with the ends of the openings 24, further movement of the needle 16 being transmitted to the valve member 13 through the pin 23, lifting the valve member 13 from the first seating 12 and permitting fuel to flow from the bore directly to the first openings 14. Such a position is illustrated in FIG. 4. It will be appreciated that in these circumstances, the flow of fuel to the first openings 14 may bypass the second openings 18, and as a result, the rate at which fuel is delivered or other injection characteristics may be altered depending on the relative shapes and sizes of the first and second openings 14, 18. The shaping of the entry end of an opening 14, 18 can have an effect on the fuel flow rate through that opening. For example, for a given diameter of opening 14, 18, the fuel flow rate therethrough will be greater if the entry end of the opening is flared outwardly, the wall of the flare being radiused, than if the entry end of the opening is plain, and such shaping can be utilised in the design of the injector to "tune" its operating characteristics.

As described hereinbefore, termination of injection may be achieved by re-applying the original downward force to the needle 16 causing the needle 16 and valve member 13 to return to the position illustrated in FIGS. 1 and 2. In order to ensure closure of the needle 16 at an optimum rate the sizing of the drillings 20 may be selected to achieve an appropriate pressure drop between the bore 11 and the chamber 19.

If fuel injection is desired at the rate achieved with the valve member 13 lifted from the first seating 12 without initially delivering fuel at the rate achieved when the valve member 13 engages its seating, then the needle 16 should be lifted from the position illustrated in FIGS. 1 and 2 to that illustrated in FIG. 4 quickly rather than holding the needle 16 in the position illustrated in FIG. 3.

Figure 6:
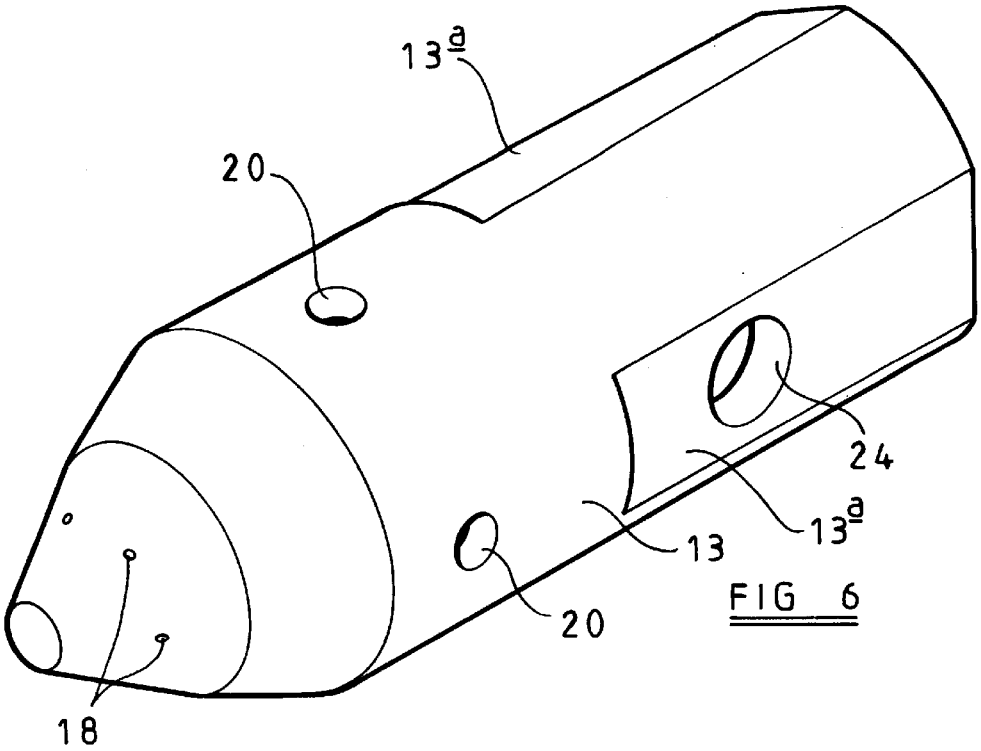
FIG. 6 is a perspective view of the valve member of the injector of FIG. 5.

In the fuel injector described hereinbefore, whilst the valve member 13 engages the first seating 12, the sliding fit between the needle 16 and the bore serves to guide the tip region of the needle 16, ensuring that the needle 16 remains concentric with the second seating 17. However, upon movement of the valve member 13 away from the first seating 12, the needle 16 is only guided at its upper end, and there is the possibility that the valve member 13 may become eccentric relative to the first seating 12. FIGS. 5 and 6 illustrate a modification to the arrangement illustrated in FIG. 1 intended to ensure that the valve member 13 remains concentric with the first seating 12 when the valve member 13 is lifted from the first seating 12. In the arrangement illustrated in FIG. 5, the bore 11 is shaped to include a guide region 11*a* of diameter substantially equal to the diameter of the adjacent part of the valve member 13. As a result, the valve member 13 is guided for sliding movement within the bore 11. In order to ensure that the flow of fuel along the bore 11 is not inhibited by the presence of the guide region 11*a* the valve member 13 is conveniently provided with a plurality of flats 13*a* or other formations defining a flow path between the valve member 13 and the guide region 11*a*.

The arrangement of FIG. 5 further differs from that of FIG. 1 in that the pin 23 is an interference fit within openings 24 provided in the valve member 13, the pin 23 riding within a slot or other kind of opening 24*a* formed in the valve needle 16. The pin 23 further projects beyond part of the valve member 13 and rides within a groove 26*a* formed in the nozzle body 10 to restrict angular movement between the valve member 13 and the nozzle body 10, thereby ensuring that the first and second openings 14, 18 align with one another when the valve member 13 engages the first seating 12.

Although in the embodiments described hereinbefore, the valve member 13 is provided with the same number of second openings 18 as the nozzle body 10 is provided with first openings 14, it will be appreciated that the valve member 13 may be provided with fewer second openings, in which case, when the valve member 13 engages the first seating 12, and the needle 16 is lifted from the second seating 17, fuel injection through only some of the first openings 14 will occur, fuel injection through the remaining openings commencing upon movement of the valve member 13 away from the first seating 12. It will be appreciated that, in such an arrangement, the shape of the spray formation may be varied as well as the rate at which fuel is delivered by varying the distance through which the valve needle 16 is lifted, in use.

In the embodiments illustrated and described with reference to FIGS. 1 to 6, it is thought that, during manufacture, the valve member 13 may be introduced into the bore 11 and held in position whilst the second openings 18 are drilled through the first openings 14. Such drilling may simply used to mark the locations in which the second openings 18 are to be formed, or the second openings may be completely drilled during such an operation.

Figure 7:
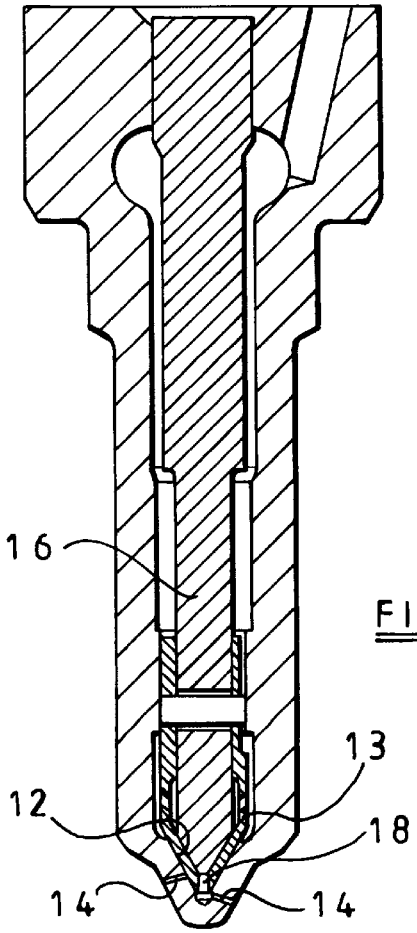
FIG. 7 is a view similar to FIG. 1 illustrating a third embodiment.

FIG. 7 illustrates an arrangement which is largely similar to that of FIG. 5, but in which the valve member 13 is provided with a single, axially extending opening 18 which communicates with a sac formed downstream of the first seating 12, the sac communicating with at least one of the first outlet openings 14. Further first outlet openings 14 are provided which do not communicate with the sac and which are covered by the valve member 13 when the valve member 13 engages the first seating 12. In such an arrangement, the initial movement of the valve needle 16 permits fuel delivery to the sac and the first openings 14 which communicate with the sac, further movement of the needle 16 lifting the valve member 13 away from the first seating and permitting fuel delivery through all of the first openings 14. By providing the nozzle body 10 with a plurality of axially and radially spaced outlet openings 14, fuel delivery can therefore occur through one or more of the outlet openings 14 depending on the extent of movement of the valve needle 16 away from the second seating 17. Thus, it will be appreciated that, in such an arrangement, the shape of the spray formation, the rate of fuel delivery and other injection characteristics may be varied depending upon the distance through which the valve needle 16 is moved, in use. The embodiment of FIG. 7 is further advantageous in that manufacture of the injector is simplified. The simplification arises from the removal of the requirement that the first and second openings 14, 18 must register with one another when the valve member 13 engages its seating.

Figure 9:
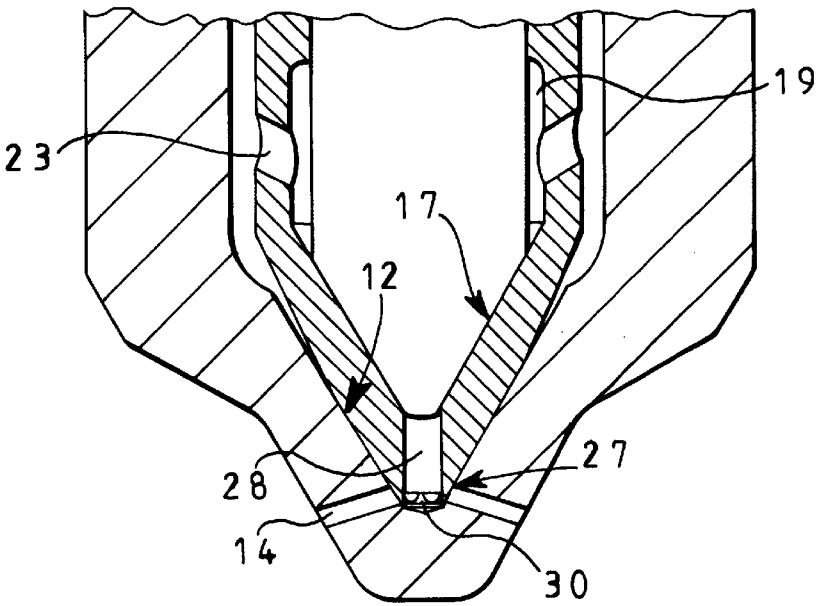
FIG. 9 is an enlarged sectional view of a part of the fuel injector in FIG. 8.
Figure 8:
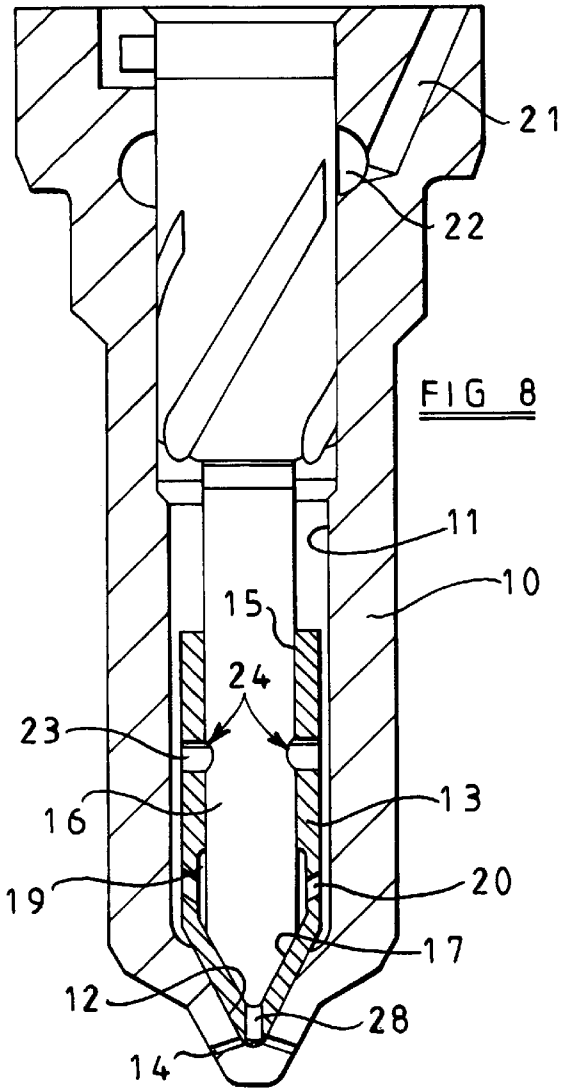
FIG. 8 is a view similar to FIG. 1 illustrating a fourth embodiment.

FIGS. 8 and 9 show a further alternative embodiment of the invention in which the fuel injector includes a nozzle body 10 provided with a blind bore 11 in which a tip portion 27 of the valve member 13 is provided with an axially extending opening 28, located downstream of the second seating 17, such that when the valve needle 16 is lifted away from the second seating 17, fuel from within the bore 11 can flow past the seating 17 through the opening 28. The tip portion 27 of the valve member 13 is of truncated, conical form, as can be most clearly seen in FIG. 8, such that, when the valve member 13 is in engagement with the seating 12, the truncated tip portion partially covers the openings 14. Typically, the tip portion 27 of the valve member 13 is truncated such that, with the valve member 13 engaging the seating 12, the flow area on entry to the outlet openings 14 is approximately half that of the flow area presented by each opening 14 if exposed. Thus, the flow of fuel through the openings 14 is throttled to permit relatively low fuel delivery rates.

The axially extending opening 28 in the valve member 13 communicates with a sac 30 formed downstream of the first seating 12, the sac 30 communicating with the outlet openings 14 formed in the nozzle body 10 to enable fuel to flow through the axially opening 28 into the sac 30 and out through the outlet openings 14, as will be described hereinafter. The sac in a conventional fuel injector, from which fuel flows to the fuel injection outlets, is generally of conical form. Preferably, however, the sac 30 in the fuel injector of the present invention is of truncated conical form, thus minimising the dead volume.

When injection of fuel is to commence, the magnitude of the downward force applied to the valve needle 16 is reduced. As a result, a point will be reached beyond which the fuel pressure within the bore 11 will apply a sufficiently large magnitude force to the valve needle 16 to cause the valve needle to lift away from the second seating 17 (i.e. out of the position shown in FIGS. 1 and 2). Provided the distance moved by the valve needle 16 is sufficiently small that the pin 23 remains spaced from the upper ends of the openings 24, the movement of the valve needle 16 is not transmitted to the valve member 13, and the fuel pressure within the bore 11 acting upon the valve member 13 will ensure that the valve member 13 remains in engagement with the first seating 12.

In such circumstances, fuel is able to flow from the bore 11 through the drillings 20 to the chamber 19, and between the valve needle 16 and the second seating 17 into the sac 30 communicating with the axially extending opening 28. Fuel is then able to flow from the sac 30 out through the openings 14 and is delivered to a combustion space of the engine with which the injector is associated. The truncation of the tip portion 27 of the valve member 13 throttles the flow to the openings 14, thus permitting relatively low flow delivery rates. As the valve member 13 engages the first seating 12, it will be appreciated that fuel is unable to flow directly to the openings 14 from the bore 11.

As described hereinbefore, termination of injection may be achieved by re-applying the original downward force to the valve needle 16 causing the needle 16 and valve member 13 to return to the position illustrated in FIGS. 1 and 2. In order to ensure closure of the valve needle 16 at an optimum rate the sizing of the drillings 20 may be selected to achieve an appropriate pressure drop between the bore 11 and the chamber 19.

If fuel injection is desired at the rate achieved with the valve member 13 lifted from the first seating 12 without initially delivering fuel at the rate achieved when the valve member 13 engages its seating, then the valve needle 16 can be lifted from the position illustrated in FIGS. 8 and 9 quickly so that fuel can immediately flow from the bore 11 directly to the openings 14, without the intermediate step of flowing through the axially extending opening 28 in the valve member 13, as described previously.

The fuel injector in FIGS. 8 and 9 provides the advantage that it is simpler to manufacture as the angular orientation of the inner valve needle 16 within the bore of the valve member 13 is not so critical. The invention also provides the advantage that the openings 14 can be located at a lower axial position in the nozzle body 10, as there are no openings in the valve member 13 with which the openings 14 must align, and thus the allowable pressure limit for the nozzle body 10 is increased. Each of the embodiments described hereinbefore may be modified in such a manner as to includes several rows of openings in the nozzle body. Further, if desired and if sufficient space is available, a second valve member, and further valve members, may be carried by the valve member to permit further levels of injection rate or other injection characteristics to be provided.

It will be appreciated that in any of the embodiments of the invention, the valve member 13 and the bore 11 may be arranged such that movement of the valve member is guided within the bore, as shown in FIGS. 5 to 7.

What is claimed is:

1. A fuel injector comprising a nozzle body provided with a first bore and defining a first seating, a valve member engageable with the first seating to control fuel flow from the first bore towards an outlet opening located downstream of the first seating, the valve member being provided with a second bore defining a second seating, a valve needle being slidable within the second bore and being engageable with the second seating to control fuel flow from the second bore towards a second outlet opening provided in the valve member, and a transmission arrangement whereby movement of the valve needle beyond a predetermined position is transmitted to the valve member.

2. The fuel injector as claimed in claim 1, wherein the transmission arrangement comprises a pin associated with the valve needle which is cooperable with openings provided in the valve member to permit movement of the valve needle beyond a predetermined amount to be transmitted to the valve member.

3. The fuel injector as claimed in claim 1, wherein the transmission arrangement comprises a pin associated with the valve member which is cooperable with an opening provided in the valve needle to permit movement of the valve needle beyond a predetermined amount to be transmitted to the valve member.

4. The fuel injector as claimed in claim 3, wherein the pin forms an interference fit within openings provided in the valve member.

5. The fuel injector as claimed in claim 1 wherein the nozzle body is provided with a plurality of first outlet openings.

6. The fuel injector as claimed in claim 1, wherein the first and second openings are located such that, when the valve member engages the first seating and the valve needle is lifted from the second seating, the first and second openings are arranged in series with one another, movement of the valve member away from the first seating permitting fuel delivery through the first outlet opening, by-passing the second outlet opening.

7. The fuel injector as claimed in claim 1, wherein the valve member is provided with a plurality of second outlet openings.

8. The fuel injector as claimed in claim 1 wherein the number of first outlet openings is equal to the number of second outlet openings.

9. The fuel injector as claimed in claim 1, wherein the valve member includes a tip portion provided with the second outlet opening to allow passage of fuel from the second bore to the first outlet opening, the tip portion being arranged to partially cover the first outlet opening when the valve member engages the first seating and being moveable to a position in which the first outlet opening is not covered by the tip portion.

10. The fuel injector as claimed in claim 9, wherein the nozzle body is provided with a plurality of axially and radially spaced first outlet openings arranged such that, in use, fuel delivery occurs through one or more of the first outlet openings depending on the extent of movement of the valve needle away from the second seating.

11. The fuel injector as claimed in claim 9 or claim 10, wherein the second outlet opening in the valve member is an axially extending opening.

12. The fuel injector as claimed in claim 9, wherein the tip portion of the valve needle is of truncated, conical form, the tip portion partially covering the first outlet opening when the valve member engages the first seating such that fuel flow through the first outlet opening is throttled to permit a relatively low fuel delivery rate.

13. The fuel injector as claimed in claim 11, wherein the fuel injector includes a sac formed downstream of the first seating and communicating with the first outlet opening, the axially extending opening in the valve member communicating with the sac to enable fuel to flow through the axially extending opening into the sac and out through the outlet opening, in use, when the valve needle is moved away from the second seating.

14. The fuel injector as claimed in claim 10, wherein the sac is of truncated, conical form.

15. The fuel injector as claimed in claim 1, comprising a pin and groove arrangement for preventing angular movement of the valve needle relative to the bore.

16. The fuel injector as claimed in claim 1, wherein the first bore includes a guide region which serves to guide movement of the valve member within the first bore.

17. The fuel injector as claimed in claim 1, wherein the valve member is provided with a drilling which communicates with the first bore to permit fuel flow between the first bore and a chamber located upstream of the second seating, the drilling being of a suitable dimension to achieve an appropriate pressure drop between the first bore and the chamber which serves to assist closure of the valve needle when it is desired to terminate fuel injection.

* * * * *